United States Patent [19]

Ryumon et al.

[11] 4,059,193

[45] Nov. 22, 1977

[54] PANEL FEEDER

[75] Inventors: Yutaka Ryumon; Naomichi Yano; Shinsuke Yukimachi, all of Osaka, Japan

[73] Assignee: Kubota, Ltd., Osaka, Japan

[21] Appl. No.: 666,568

[22] Filed: Mar. 12, 1976

[30] Foreign Application Priority Data

Mar. 14, 1975 Japan ..... 50-35195[U]
Mar. 19, 1975 Japan ..... 50-37814[U]

[51] Int. Cl.[2] ..... B65G 59/04

[52] U.S. Cl. ..... 214/8.5 A; 214/1 BT; 214/8.5 D; 271/30 A; 271/108

[58] Field of Search ..... 271/108, 107, 30 A, 271/12; 214/8.5 R, 8.5 A, 8.5 D, 6 FS, 1 BT, 1 S, 7; 294/64 R, 65

[56] References Cited

U.S. PATENT DOCUMENTS

| | | | |
|---|---|---|---|
| 1,472,262 | 10/1923 | Abildgaard | 294/19 R X |
| 2,361,176 | 10/1944 | Carvey | 214/8.5 D X |
| 2,761,680 | 9/1956 | Lens | 271/12 |
| 3,718,217 | 2/1973 | Stobb et al. | 214/8.5 D X |

*Primary Examiner*—Frank E. Werner
*Attorney, Agent, or Firm*—Armstrong, Nikaido & Marmelstein

[57] ABSTRACT

A panel feeder comprising a vacuum case having a vacuum suction opening at its front end and a closure in engagement with a stationary cover communicating with a vacuum source. The vacuum case is reciprocally slidingly movable by reciprocating means relative to a block of panels arranged substantially vertically side by side to cause the suction opening to feed the panels one by one by vacuum suction to a cutting apparatus operatively connected to the reciprocating means.

6 Claims, 12 Drawing Figures

PANEL FEEDER

BACKGROUND OF THE INVENTION

When feeding asbestos cement slates for roofing or like panels to a cutter to cut the panels to the desired dimensions and punch nail holes, the operator usually takes off the panels one by one manually from panel blocks and feeds them to the cutter in timed relation to the cutting or punching action of the cutter. With such method, the feed rate is lower than is afforded by the machine, and a very poor operation efficiency will result. Moreover, the manual feeding operation requires a skilled operator.

SUMMARY OF THE INVENTION

An object of this invention is to provide a feeder comprising a stationary cover connected to a vacuum duct and having an inlet, and a vacuum case having a closure and hermetically slidably engaging the cover, with the inlet of the stationary cover in communication with an air aperture in the closure, so as to render the duct fixed to the cover and free of any deformation, while always imparting suction to the vacuum case.

Another object of this invention is to provide a panel feeder in which panels stacked in horizontal position to a block are caused to fall onto a slanting support plate to release the panels from intimate contact with each other for separation and which is therefore capable of readily feeding the panels one by one to a subsequent process.

DETAILED DESCRIPTION OF THE INVENTION

Figure 1:
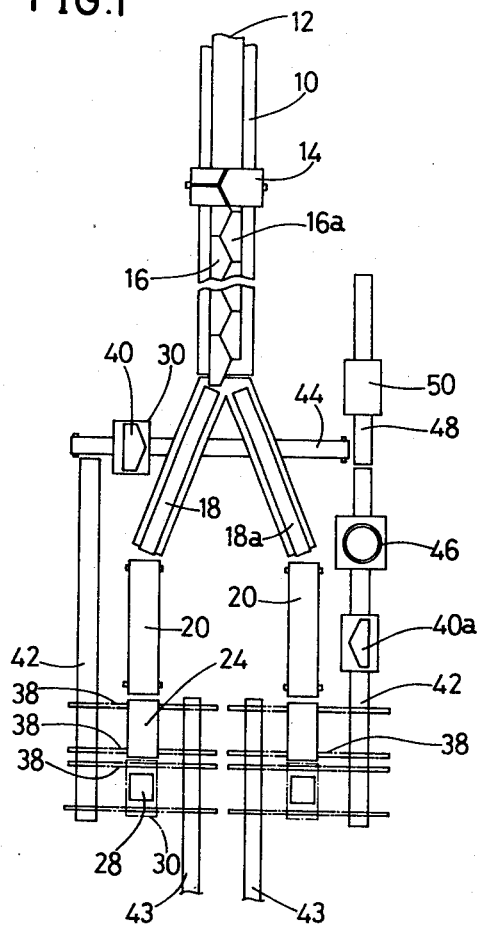
FIG. 1 is a plan view showing an apparatus for producing unhardened slates by which a strip of slate material are cut to the shape of the slate and the cut pieces are then sent out along a bifurcated path.
Figure 2:
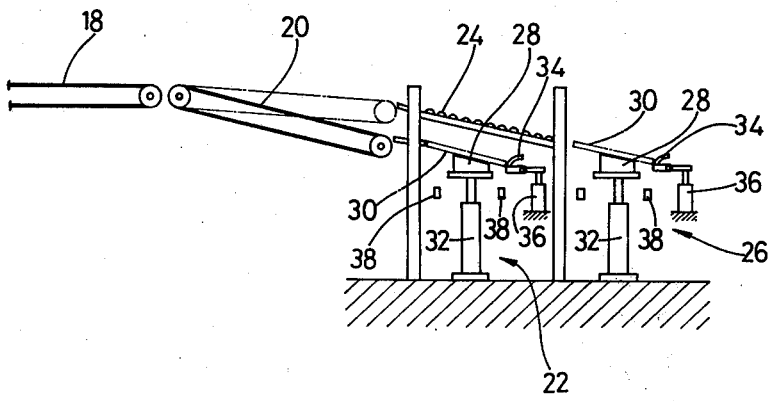
FIG. 2 is a front view showing the pivotable conveyors and stacking means of FIG. 1.

FIGS. 1 and 2 show an apparatus for producing roofing slates by preparing soft, unhardened or green slates in the shape of a shingle from a mixture of cement, asbestos and siliceous sand and stacking a number of the green slates on a pallet 30 to obtain a slate block 40.

The mixed slate material is transported on a belt conveyor 10 in the form of a layer of uniform thickness and, during transport, the material is roll-pressed to a strip 12 with application of water. When the strip 12 passes beneath a roller 14 provided with a cutting blade, a cut line is formed in the strip which line defines two roofing slates 16 and 16*a* as arranged in opposed relation to each other.

The forward end of the belt conveyor 10 is bifurcated in V-shape to provide two belt conveyors 18 and 18*a*, whereby the green slates are aligned into two rows 16 and 16*a*. Provided for each of the conveyors 18 and 18*a* are a pivotable conveyor 20 having a vertically movable front end, first stacking means 22 provided for the conveyor 20 in its lowered position and a transfer chute 24 for the same conveyor in its raised position. Second stacking means 26 is disposed at the forward end of the transfer chute 24.

Each of the stacking means 22 and 26 comprises a support 28 having a top surface so inclined as to receive the soft green slates sent forward on the pivotable conveyor 20, a lift 32 for lowering the support 28 by an amount corresponding to the thickness of the slate every time the slate is transferred onto the pallet 30 on the support 28, and a stopper 34 for retaining the slates immediately above the support 28 as they slide along above the support 28 one after another to form a stack of slates. The stopper 34 is coupled to an adjuster 36 for progressively forwardly shifting the position at which the green slates are to be halted, whereby the forward ends of the slates stacked as a block 40 are aligned vertically with respect to the pallet 30.

A pair of chain conveyors 38 are arranged on the front and rear sides of each of the support 28. When the support 28 descends to a delivery position with a predetermined number of green slates loaded on the pallet 30 thereon, the slate block is transferred onto the chain conveyors 38 along with the pallet 30. The chain conveyors 38 carry the block 40 to a vertically shiftable roller conveyor 42 and transfer the block to the roller conveyor 42.

Near the starting end of each pair of chain conveyors 38, a conveyor 43 for automatically feeding pallets is associated with the pair of conveyors 38. For the support 28 having delivered the pallet 30 in its lowered and now in its standby position, the conveyor 43 transfers a new pallet 30 onto the starting end of the conveyors 38, which in turn convey the pallet 30 to immediately above the support 28 and automatically transfers the pallet 30 onto the top of the support 28 when the latter subsequently ascends.

The slate block 40 transferred to the roller conveyor path 42 on the left-hand side of FIG. 1 is thereby conveyed along with the pallet and thereafter transferred to a conveyor path 44 disposed at a right angle with the path 42.

The slate block 40*a* in transit, as supported on the pallet 30, on the other roller conveyor path 42 is oriented in the opposite direction to the slate block 40 on the conveyor path 44 and is therefore unable to join the latter block. Accordingly, the conveyor path 42 is provided at an intermediate portion thereof with means 46 for turning the block 40*a* through 180° so that both blocks 40 and 40*a* will be oriented in the same direction when joined together at the junction of both the paths 42 and 44.

A joint conveyor 48, further extending from the junction, receives slate blocks alternately from the two conveyor paths 42 and 44. Stacking means 50 combines each two blocks into one block and sends them forward. The blocks are then allowed to stand for two to three days and hardened.

Figure 3:
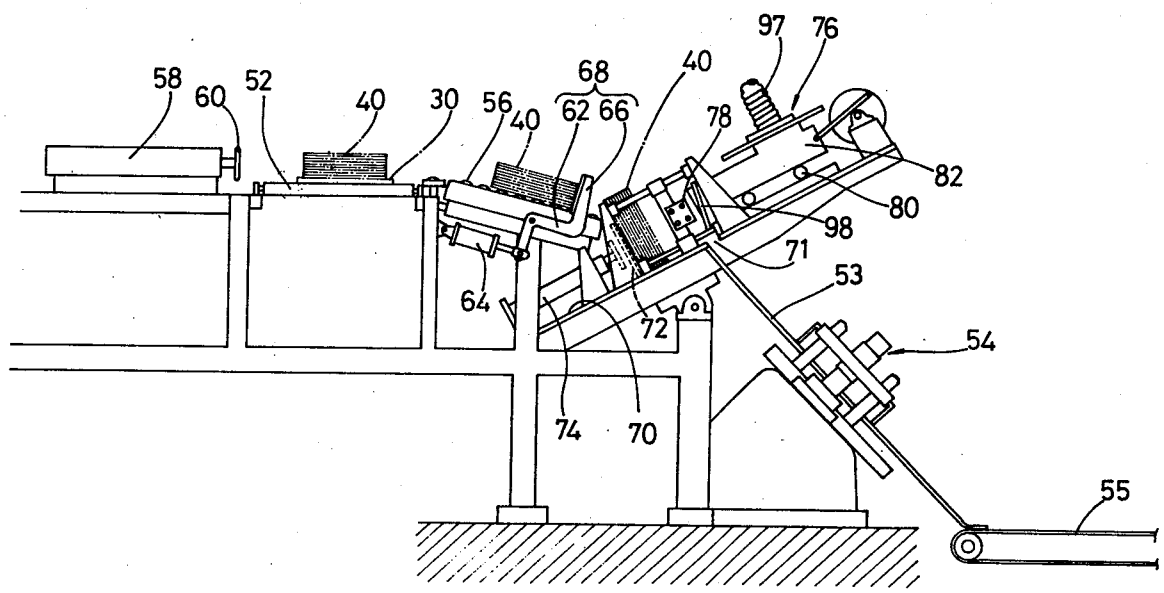
FIG. 3 is a front view showing a feeder for separating slate blocks into individual slates and then feeding the slates to a cutting apparatus one by one.
Figure 5:
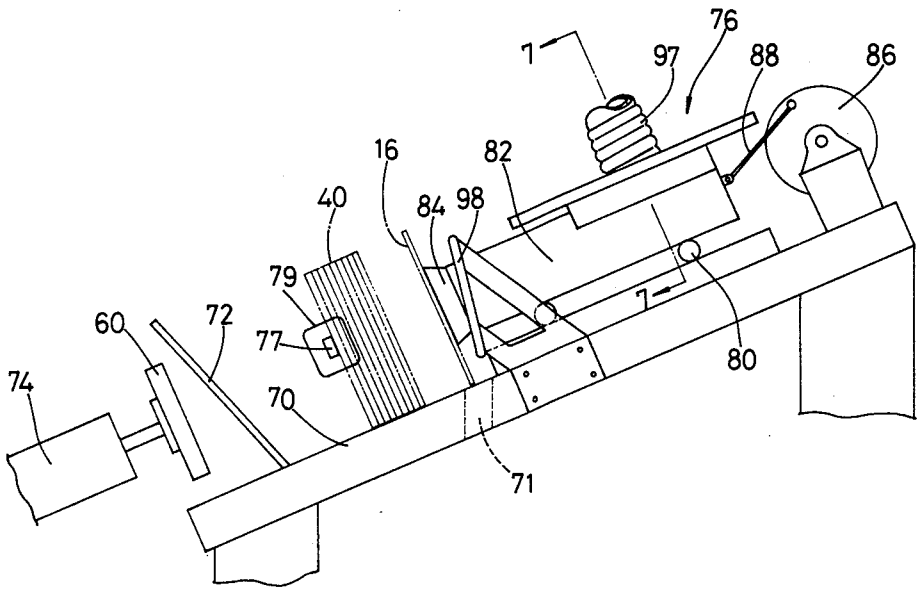
FIG. 5 is an enlarged front view showing the vacuum case of FIG. 3.
Figure 6:
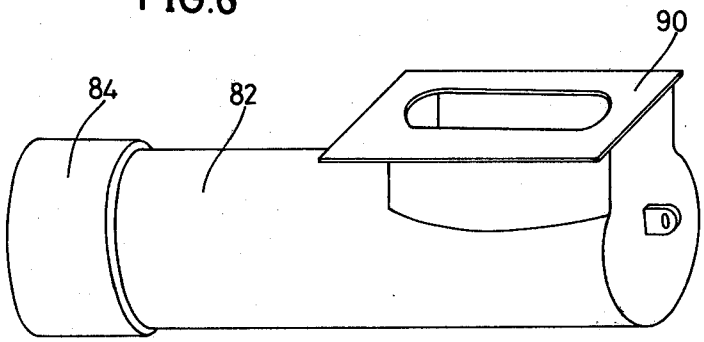
FIG. 6 is a perspective view showing the vacuum case alone as separated from a stationary cover.
Figure 7:
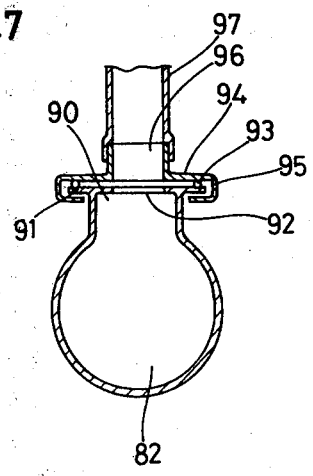
FIG. 7 is a view in section taken along the line 7—7 in FIG. 5.
Figure 8A:
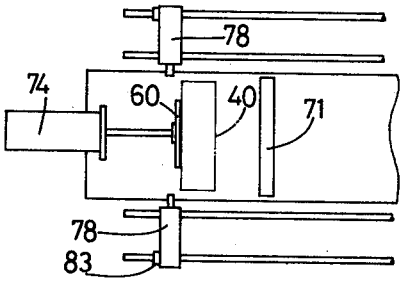
FIGS. 8 (*a*) to (*e*) are plan views of pushing means and supporting means for pushing slate blocks and feeding the slates to illustrate the operation of these means stepwise.
Figure 8B:
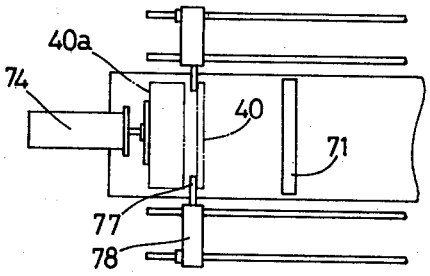
Figure 8C:
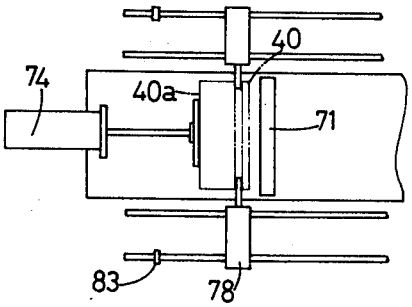
Figure 8D:
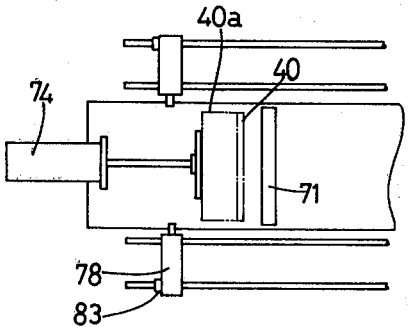
Figure 8E:
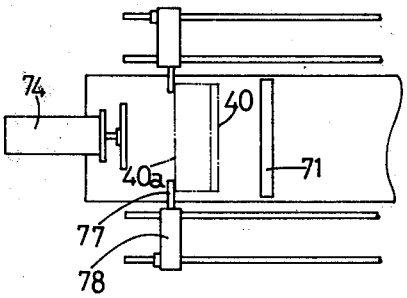

When the slates have been fully hardened, the blocks 40 are transferred onto a conveyor 52 shown in FIG. 3, from which they are fed to a cutting apparatus 54.

Arranged on the opposite sides of the conveyor 52 at its forward end are a pusher 58 and a transfer passage 56 downwardly inclined toward its front end and extending at a right angle to the conveyor 52. When the slate block 40 is halted along with the pallet 30 at a position opposite to the transfer passage 56, the pushing member 60 of the pusher 58 advances, pushing the slate block 40 alone onto the transfer passage 56, whereupon the block 40 moves down the inclined transfer passage 56. The pallet 30 remaining on the conveyor 52 is sent out by the conveyor 52 which is subsequently driven.

At the lower end of the transfer passage 56, a stopper 68 is disposed which comprises an L-shaped arm 62 pivotally supported at its midportion and having one end connected to drive means 64 such as piston-and-cylinder means. The other end of the stopper 68 has an abutting member 66 projectable into the path of transfer of the block on the passage 56 and retractable therefrom. The slate block 40 descending the transfer passage 56 is therefore temporarily restrained by the stopper 68.

A slanting support plate 70, obliquely upwardly extending toward its front end, is provided below the front end of the transfer passage 56, the difference in elevation between the end and the plate being approximately equal to the height (about 40 cm) of the slate. Inclined guide plates 72 for supporting the slates at the opposite sides thereof are interposed between the front end of the passage 56 and the support plate 70. When the abutting member 66 is retracted downward from above the transfer passage 56, the slate block 40 retained on the passage 56 by the stopper 68 falls under gravity along the guide plates 72 onto the support plate 70 with slight impact.

By virtue of the impact, the stacked slates are released from intimate contact with each other and separated into individual slates, thereby being rendered feedable one by one. The slates of the block are supported by the plates 72 as arranged side by side substantially in vertical position relative to the plate 70.

The slanting support plate 70 is provided with pushing means 74, such as pneumatic piston-and-cylinder means, at a lower portion thereof and feeding means 76 at an upper portion thereof. Disposed between the two means 74 and 76 are means 78 for supporting the slate block 40 at the advanced position of the feeding means 76. The block supporting means 78 are projectable to and retractable from above the support plate 70 and are slidable along the slanting support plate 70. The feeding means 76 includes a hollow vacuum case 82 reciprocally movably supported by rotatable rollers 80 on the support plate 70 and having an open lower end provided with a pad 84. The pad is made of an elastic material. The open end of the vacuum case 82 opposes the slate block 40. The upper end of the vacuum case 82 is connected, by a flexible line 88 such as a chain or wire, to an eccentric point of a rotary disc 86 mounted on the upper end of the support plate 70, such that the rotation of the disc 86 pulls the vacuum case 82 upward along the support plate 70, the vacuum case 82 being allowed to descend under gravity when the eccentric point has passed the top dead center. In this way, the vacuum case 82 is reciprocally movable in repetition.

The vacuum case 82 has a top closure 90 in the form of a flat plate. The closure includes flange 91 and 91 projecting outwardly from the opposite sides of the case and is formed with an elongated air aperture 92 in its center.

A stationary cover 94, which is secured to a frame and is therefore immovable, is disposed close to the closure 90 on the vacuum case 82 in opposed relation thereto. The opposite edges of the stationary cover 94 are inwardly bent in a U-shape to provide guide grooves 95, 95 in which the flanges 91, 91 of the vacuum case 82 are slidably engaged. A sealing member 93 interposed between the stationary cover 94 and the flanges 91 forms a hermetic joint therebetween.

The stationary cover 94 has a center intake or inlet 96 which is connected to one end of a duct 97 in communication with vacuum means (not shown). Since the air aperture 92 formed in the closure 90 of the vacuum case 82 has a sufficient length, the vacuum case 82 is maintained, during reciprocation, in communication with the inlet 96 of the stationary cover 94 by way of the aperture 92, always causing the opening of the pad 84 at the lower end to exert a sucking force. The stationary cover 94, which is fixed in position, renders the duct 97 free of any deformation and serviceable for a prolonged period of time.

A discharge opening 71 slightly longer than the lateral width of the slate 16 is formed in the slanting support plate 70 at a position immediately in advance of the lower end of the vacuum case 82 in its raised position. A chute 53 extends downwardly from the discharge opening 71 to the feed inlet of the cutting apparatus 54. As already known, the cutting apparatus includes a stopper, by which the slate sliding down the chute 53 is temporarily stopped in position. The slate is trimmed to the specified dimensions and thereafter sent out onto a discharge conveyor 55.

A pair of blocking members 98 and 98 are provided for, and disposed above, the discharge opening 71 and project inwardly of the support plate 70. The blocking members 98 are inclined with respect to the plate 70 toward its upper end. Accordingly, when the vacuum case 82 retracts, with the slate adhered to its pad 84 by suction, the lower portion of the slate 16 first strikes against the blocking members 98, which in turn impedes the slate and releases the slate 16 from the suction opening of the pad as if peeling the slate off the opening. Thus, upon the vacuum case 82 coming into communication with the atmosphere, the suction abruptly decreases, with the result that the slate 16, obstructed by the blocking members 98, falls through the discharge opening 71.

Each of the block supporting means 78 located on the opposite sides of the support plate 70 comprises an air cylinder 79 provided with a block supporting pawl 77 and slidably mounted on a guide 81 extending in parallel to the slanting support plate 70. The means 78 is halted, against downward movement, by a stopper 83 mounted on the guide 81 at a position corresponding to the lowered position of the pad 84 on the vacuum case 82, whereas the means 78 is free to move upward.

Figure 4:
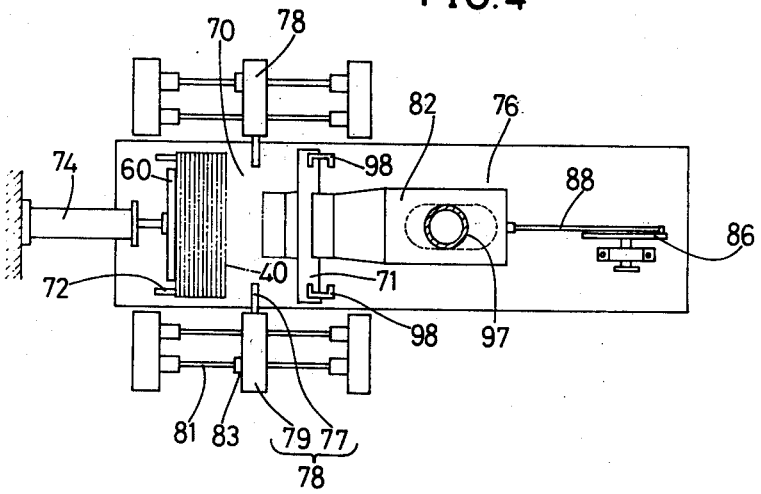
FIG. 4 is a plan view of FIG. 3.

As illustrated in FIG. 4 and FIGS. 8 (*a*) to (*e*), the block 40 falling onto the support plate 70 is first pushed by pushing means 74 upward beyond the halted position of the block supporting means 78 (FIG. 8 (*a*)). The supporting pawls 77 project and receive the block 40 and, simultaneously with this, the pushing means 74 retracts. The feeding means 76 functions to take off the slate one by one from the block and discharge them through the opening 71. When a predetermined member of slates have been discharged for feeding, a new slate block **40*a* is placed on the support plate 70 (FIG. 8** (*b*)), whereupon the pushing means 74 operates to push up the block 40*a* along with the block 40 on the supporting pawls 77 (FIG. 8 (*c*)). The supporting means 78 then retract their pawls 77, with the result that the means 78 slide down the guides 81 and are halted at a position below the pushing member 60 on the pushing means 74 by the stoppers 83 (FIG. 8 (*d*)). When the pushing member 60 retracts, both two blocks 40 and 40*a* are supported by the pawls 77 (FIG. 9 (*e*)), and the steps of FIG. 8 (*b*) to (*e*) are thereafter repeated, whereby the slate blocks are handled in succession and the slates are fed one after another.

Although the foregoing embodiment has been described with reference to the case in which slates are handled, this invention is similarly useful for feeding various other panels, for example, those made of wood, plastics, etc.

This invention is not limited to the embodiment described above and illustrated in the drawings. It is to be understood that other changes and modifications may be made by those skilled in the art without departing from the scope of this invention.

What is claimed is:

1. A panel feeder comprising a vacuum case provided at its front end with a vacuum suction opening and supported for reciprocal movement relative to a block of panels arranged substantially vertically side by side, reciprocating means coupled to the case to bring the suction opening toward or away from the panel block, a slanting panel support plate extending obliquely upward, the vacuum case being slidable in parallel to the support plate, the support plate being formed in its upper portion with a panel discharge opening immediately in front of the retracted position of the vacuum case, blocking members disposed above the discharge opening to impede the panel by contact therewith, and panel block pushing means disposed on a lower portion of the slanting support plate to push the panel block to the advanced position of the vacuum case, the vacuum case having a closure slidably engaging a stationary cover, the stationary cover having an inlet connected to a duct in communication with vacuum means, the closure being formed with an air aperture always in communication with the inlet of the stationary cover over the range of reciprocal movement of the vacuum case so as to maintain a vacuum within the vacuum case and to cause the vacuum suction opening to perform a vacuum sucking action, whereby the panels are fed one by one to an apparatus subsequent to the feeder.

2. A panel feeder as defined in claim 1 wherein the closure of the vacuum case is in the form of a flat plate and includes flanges projecting outwardly from the opposite sides of the case, and the stationary cover has a pair of inwardly open guide grooves, the flanges being slidably engaged in the guide grooves.

3. A panel feeder as defined in claim 1 wherein a pair of block supporting means are provided on the opposite sides of the support plate and at the pushing position of the pushing means, the block supporting means being projectable to and retactable from above the support plate, the block supporting means being upwardly slidable along the support plate.

4. A panel feeder as defined in claim 1 wherein a transfer passage for the panel block and a stopper projectable into and retractable from the path of transfer of the block at the front end of the passage are provided above a lower portion of the slanting support plate so as to permit the panel block to fall under gravity from the front end of the transfer passage onto the support plate.

5. A panel feeder as defined in claim 1 wherein a panel cutting apparatus is disposed below the panel discharge opening with a guide chute extending from the discharge opening to the cutting apparatus.

6. A panel feeder as defined in claim 1 wherein said reciprocating means includes a flexible line, said reciprocating means pulling said casing upward along said support plate and allowing said casing to return down along said support plate under the influence of gravity.

* * * * *